US011790881B2

(12) United States Patent
Sergeev et al.

(10) Patent No.: US 11,790,881 B2
(45) Date of Patent: Oct. 17, 2023

(54) PLASMA BASED NOISE REDUCTION SYSTEM

(71) Applicant: ECOLE POLYTECHNIQUE FEDERALE DE LAUSANNE (EPFL), Lausanne (CH)

(72) Inventors: Stanislav Sergeev, Chavannes-Renens (CH); Hervé Lissek, Renens (CH); Maxime Volery, Cottens (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 0 days.

(21) Appl. No.: 17/857,622

(22) Filed: Jul. 5, 2022

(65) Prior Publication Data

US 2023/0020879 A1 Jan. 19, 2023

(30) Foreign Application Priority Data

Jul. 6, 2021 (EP) ..... 21184056

(51) Int. Cl.
*G10K 11/178* (2006.01)

(52) U.S. Cl.
CPC ..... *G10K 11/17853* (2018.01)

(58) Field of Classification Search
CPC . G10K 2210/3212; G10K 2210/32121; G10K 2210/118; G10K 2210/3219; G10K 11/1785; H04R 23/004
See application file for complete search history.

(56) References Cited

U.S. PATENT DOCUMENTS 5,251,263 A 10/1993 Andrea et al.
10,720,137 B1 7/2020 Hall et al.

FOREIGN PATENT DOCUMENTS

WO 2007/127810 11/2007

OTHER PUBLICATIONS

Search Report for EP21184056.6, dated Dec. 14, 2021, 12 pages.
Sergeev et al., "Development of a plasma electroacoustic actuator for active noise control applications", Journal of Physics D: Applied Physics, Institute of Physics Publishing, vol. 53, No. 49, Sep. 23, 2020, p. 495202, XP020359407.
Bhan et al., "Active Acoustic Windows: Towards a Quieter Home", IEEE Potentials, IEEE, vol. 35, No. 1, Jan. 1, 2016, pp. 11-18, XP011592079.

(Continued)

*Primary Examiner* — Kile O Blair
(74) *Attorney, Agent, or Firm* — Nixon & Vanderhye P.C.

(57) ABSTRACT

An active noise reduction system (2) comprising an electroacoustic plasma transducer (5) for mounting in an installation structure and an acoustic sensing system (11). The electroacoustic plasma transducer comprises a plasma electrode arrangement (6) including a collector electrode (8) and a corona electrode (9), and a control system (7) connected to the plasma electrode arrangement for supplying power to the plasma electrode arrangement. The control system comprises a controller (12), and a amplification circuit (13). The acoustic sensing system is connected to the control system providing a measurement signal of an environmental sound to control the output of the electroacoustic transducer for reducing noise. The control system comprises a filter implementing a control transfer function θ(ω) based on a model of the electroacoustic plasma transducer.

26 Claims, 7 Drawing Sheets

(56) References Cited

OTHER PUBLICATIONS

Bastien et al., "Review Article; Acoustics and gas discharges: applications to loudspeakers", Journal of Physics D: Applied Physics, Institute of Physics Publishing, vol. 20, No. 12, Dec. 14, 1987, pp. 1547-1557, XP020014251.
Kuo et al., "Active Noise Control: A Tutorial Review", Proceedings of the IEEE, IEEE, vol. 87, No. 6, Jun. 1, 1999, pp. 943-973, XP011044219.
Bequin et al., "Modeling plasma loudspeakers", The Journal of the Acoustical Society of America, American Institute of Physics, vol. 121, No. 4, May 8, 2007, pp. 1960-1970, XP012096517.

PLASMA BASED NOISE REDUCTION SYSTEM

This application claims priority to EP 21184056.6, filed Jul. 6, 2021, the entire contents of which is hereby incorporated by reference.

FIELD OF INVENTION

This invention relates to a plasma electroacoustic system for sound manipulation, in particular for sound reduction such as noise cancellation and sound absorption.

BACKGROUND OF THE INVENTION

In many conventional active noise control technologies, electrodynamic loudspeakers (comprising a vibrating membrane, a permanent magnet, and an electrical coil) are used.

Regarding duct noise reduction (such as ventilation noise and exhaust gas noise), noise cancellation systems are typically implemented with wall mounted transducers, since the loudspeaker membrane is impermeable to the gas. Active control to reduce noise in an efficient manner is however challenging with such systems. Although active sound absorption with conventional transducers is known to improve performance over the passive methods because absorption can be generally achieved over a greater bandwidth than with a passive material, it is still limited around the natural resonance frequency of the loudspeaker mechanical system (vibrating diaphragm) [1]. Such kind of absorber has generally limited performance at high frequencies as well. Also, when assembling such loudspeakers in arrays, as for example is the case of acoustic liners for aircraft applications (large surfaces for engine ducts noise reduction), the total weight of the absorber can become unacceptable [2].

Sound insulation in conventional double panel windows is known to progressively weaken towards the low frequencies [3], which is difficult to address with passive methods. Active noise reduction methods proved their efficiency to significantly reduce sound transmission in the low frequency range [4]. However, the use of electrodynamic loudspeakers within the window panels is impractical due to the driver's opacity. To this end, almost fully transparent piezoelectric films were designed to substitute the loudspeakers [5]. Despite their good performance at low sound pressure levels of noise, they are not yet able to work with high sound pressure levels.

Plasma-based electroacoustic transducers present several advantages over the conventional electrodynamic ones. The absence of the membrane, suspension and any other moving parts, reduces weight, increases mechanical robustness, and does not present mechanical resonance.

The work [8] by Bastien overviews possible plasma-based concepts for the sound reproduction. It discusses the physical mechanisms which allow the generation of sound waves in various gas discharge types. In the arc discharge, the modulation of electrical current varies the amount of heat dissipation in the gas between the electrodes. Such heat change provokes a local gas density fluctuation which finally produces a sound wave. Corona discharge generates sound in a different way. It provides gas ionization only in the region close to the emitter electrode. The ions further drift to the collector electrode transferring their mechanical momentum to the surrounding neutral gas particles and finally creating the flow often called ionic wind. The modulation of flow velocity yielded by the electrode voltage variation compresses the air and generates sound waves. The work by Bequin [9] suggests an electrical model specifically designed for the point to plane corona discharge which can describe the acoustic behavior of the actuator in free space with far field approximation. However, such actuator's configuration was able to produce only miniscule sound pressure levels which is impractical for manipulation of audible sounds. Moreover, to set the model parameters, the whole set of frequency response and directivity patterns measurements is required.

WO 2007/127810 relates to an electroacoustic transducer producing sound due to a vibratory movement of the corona discharge generated fluid flow. This publication however does not describe any system linked to active noise control applications and the electroacoustic transducer control system and setup described therein would not be adapted for active noise control applications.

Sergeev et al. [13], [14] investigates a corona discharge (CD) actuator in wire to mesh geometry and its potential application to the active noise control. The first work [13] discusses the physical principles of sound generation process of the CD actuators. Although the paper points out several advantages of the CD-based electroacoustic transducers over the conventional electrodynamic ones and concludes that the CD-based actuators are potentially suitable for active noise control applications, it describes sound radiation mechanisms in free space and remains valid only in field approximation in the low frequency range. It does not describe the transducer's near field radiation which is of high importance for active sound control. Additionally, the study does not guide on any possible implementation of the system for active noise control applications. The second study [14] demonstrates the implementation of one sound absorption method which does not require any analytical model of the corona discharge actuator. The actuator considered in the study has a particular geometrical and electrical parameters and the scaling of the actuator is not proposed. Moreover, the achieved absorption is not optimal and in particular cannot reach frequencies as low as 100 Hz.

Conventional systems with plasma actuators typically use power supplies with bulky transformers which have only a single high voltage output signal. Thus such systems are limited in the actual applications of active noise reduction for which they may be used where many individually powered actuators are needed.

SUMMARY OF THE INVENTION

In view of the foregoing, an object of the invention is to provide an active noise reduction that is compact and that may be implemented in various structures for effective noise reduction or other desired sound manipulation effects.

It is advantageous to provide an active noise reduction system that is effective over a large frequency range, in particular including frequencies below 100 Hz and higher than 1000 Hz.

It is advantageous to provide an active noise reduction system that is lightweight.

It is advantageous to provide an active noise reduction system that is safe.

Objects of this invention have been achieved by providing an active noise reduction system according to claim 1.

Disclosed herein is an active noise reduction system comprising an electroacoustic plasma transducer for mounting in an installation structure and an acoustic sensing system. The electroacoustic plasma transducer comprises a plasma electrode arrangement including a collector electrode and a corona electrode, and a control system connected to the plasma electrode arrangement for supplying power to the plasma electrode arrangement. The control system comprises a controller, and a amplification circuit. The acoustic sensing system is connected to the control system providing a measurement signal of an environmental sound to control the output of the electroacoustic transducer for reducing noise. The control system comprises a filter implementing a control transfer function $\theta(\omega)$ based on a model of the electroacoustic plasma transducer.

In an advantageous embodiment, the filter implementing said control transfer function $\theta(s)$ is further based on a frequency-dependent target acoustic impedance $Z_{tg}(\omega)$.

In an advantageous embodiment, the acoustic sensing system comprises a microphone connected to the control system and placed on an open side of the plasma electrode arrangement facing a source of noise to be reduced.

In an advantageous embodiment, the filter outputs a voltage signal $u_{AC}(s)$ fed into the amplification circuit of the control system configured to drive the electrode arrangement to achieve said frequency-dependent target acoustic impedance at the position of the microphone.

In an advantageous embodiment, the microphone is positioned at a distance of less than 20 mm from the open side of the plasma electrode arrangement.

In an advantageous embodiment, the filter is an Infinite Impulse Response (IIR) filter.

In an advantageous embodiment, said model of the electroacoustic transducer comprises parameters selected from any one or more of:

- geometrical parameters, such as: a distance d between the corona electrode and the collector electrode, a cross section area of the electrode arrangement $S_e$, a distance L from a center of electrode arrangement to an enclosure;
- a back impedance $Z_L$ corresponding to the presence of an enclosure behind the electrode arrangement;
- environmental parameters, such as: ambient gas temperature $T_0$, sound speed in gas c, gas mass density $\rho$;
- discharge parameters, such as: effective ion mobility critical $\mu_i$, corona voltage $U_0$, and dimensional constant C.

In an advantageous embodiment, said discharge parameters critical corona voltage $U_0$ and dimensional constant C are obtained by applying different constant voltages U and recording the electrical currents I between the corona and collector electrodes whereby for data points where said current is not zero, a recorded curve can be fitted with formula $I=CU(U-U_0)$ and therefrom the critical corona voltage $U_0$ and dimensional constant C parameters can be obtained.

In an advantageous embodiment, the amplification circuit comprises a feedback line connected between the electrode arrangement and the amplification circuit.

In an advantageous embodiment, the amplification circuit comprises a plurality of amplification channels connected to a plurality of said plasma electrode arrangements configured to feed each electrode arrangement with an individual alternating electrical voltage signal.

In an advantageous embodiment, each amplification channel of the amplification circuit comprises a vacuum tube.

In an advantageous embodiment, each amplification channel of the amplification circuit comprises a load resistor that may have a different value from load resistors of other channels for setting the amplification level of each channel adapted to the desired operation of the electrode arrangement connected thereto.

In an advantageous embodiment, the amplification circuit comprises a DC power supply, a switched mode circuit connected to the DC power supply, and a transformer and rectifier connected to the switched mode circuit.

In an advantageous embodiment, an anode of said vacuum tube is connected to the output of the rectifier via said load resistor.

In an advantageous embodiment, the collector electrode is at least partially transparent.

In an advantageous embodiment, the amplification circuit generates a maximum transducer operating voltage in a range of 5 to 20 kV, more preferably in a range of 5 to 15 kV.

In an advantageous embodiment, a distance d between the corona electrode and the collector electrode, and maximum transducer operating voltage difference $U_{max}$, between the corona electrode and collector electrode, is chosen in order to satisfy the relation: $U_{max}/d=1.8$ MV/m–2 MV/m.

In an advantageous embodiment, the corona electrode comprises an array of electrode segments spaced from each other at a distance between 1.5*d and 3*d, where d is the closest distance between the corona electrode and the collector electrode.

In an advantageous embodiment, the electroacoustic plasma transducer comprises an enclosure on one side of the plasma electrode arrangement.

In an embodiment, said plurality of plasma electrode arrangements comprises one corona electrode and a plurality of collector electrodes associated with said one corona electrode.

In an embodiment, the plurality of collector electrodes form together a 3D shape surrounding the corona electrode.

In an embodiment, the 3D shape is substantially spherical.

In an embodiment, the plurality of electrode arrangements are installed in a window.

In an embodiment, the plurality of electrode arrangements are installed in a frame of window.

In an embodiment, the plurality of electrode arrangements are installed in a plenum of the window, substantially parallel to a panel of the window.

In an embodiment, the plurality of electrode arrangements are installed in an exhaust or ventilation duct.

In an embodiment, the plurality of electrode arrangements are installed transversely across an axis of the exhaust or ventilation duct.

The noise reduction solution proposed in the present patent application can offer visual transparency and higher mechanical robustness of the actuators. The control system according to embodiments of the invention may employ a control method using an analytical model of the transducer with parameters tuned experimentally to take into account the actual behaviour of the transducer that allows achieving optimal absorption in the wide frequency range. The flexibility in geometry and distributed control of several transducers can progressively improve sound insulation performance compared to conventional active window technologies.

Further objects and advantageous aspects of the invention will be apparent from the claims, and from the following detailed description and accompanying figures.

BRIEF DESCRIPTION OF THE DRAWINGS

The invention will now be described with reference to the accompanying drawings, which by way of example illustrate embodiments of the present invention and in which.

DETAILED DESCRIPTION OF EMBODIMENTS OF THE INVENTION

Figure 1C:
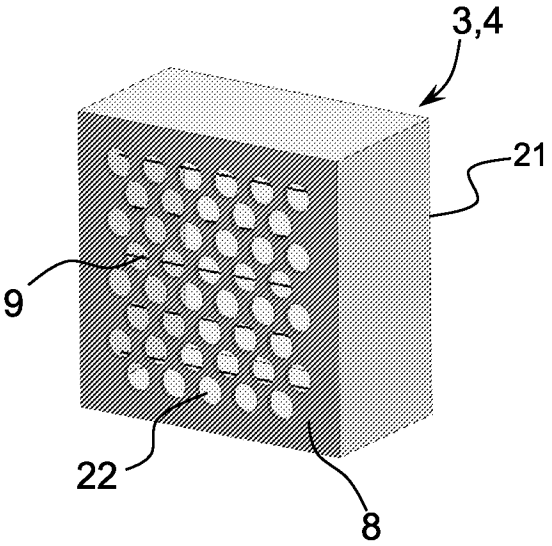
FIG. 1*c* is a simplified schematic perspective view of an electrode arrangement of an active noise reduction system according to another embodiment of the invention.
Figure 1A:
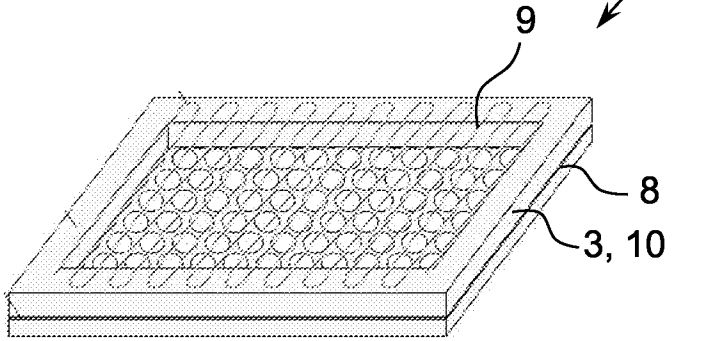
FIG. 1*a* is a schematic simplified view of a substantially planar electrode arrangement of an active noise reduction system according to an embodiment of the invention.

Referring to the figures, an active noise reduction system 2 according to embodiments of the invention, comprises an electroacoustic plasma transducer 5, a sensing system 11, and a support 3. The support 3 may be configured for mounting to an installation structure 1, or the support may form a portion of an installation structure.

The installation structure may be of various types depending on the application. The purpose of the active noise reduction system is to reduce or cancel undesirable acoustic sources in the environment it is placed. It can be used in various installation structures, such as rooms, ventilation ducts, motor and machine enclosures, windows, exhaust systems, and other installations where noise reduction is desired.

The electroacoustic plasma transducer 5 comprises an electrode arrangement 6 and a control system 7 connected to the electrode arrangement supplying power to the electrode arrangement and controlling operation of the electroacoustic plasma transducer 5.

The electrode arrangement 6 comprises a collector electrode 8 and a corona electrode 9, supported by a support frame 10. The electrode providing gas ionization in its vicinity is referred as corona or emitter electrode. The electrode, attracting the ion flow is referred to as the collector electrode. The transducer electrodes can be made of any conducting or semiconducting material. Since the emitter electrode is subject to an intensive oxidation, the preferred material of the corona electrode or at least an outer layer thereof is resistive to oxidation for example, stainless steel or nickel-chromium alloy. In illustrated embodiments, the corona electrode comprises a thin wire. In variants, the corona electrode may comprise a needle or blade. In embodiments, to increase the acoustic power, the corona electrode can be made of an array of wires, needles, blades. A typical thickness of the corona electrode is in a range of 0.1 to 1 mm, preferably in a range of 0.1 to 0.5 mm.

In an embodiment requiring visual transparency, for instance where the collector electrode is incorporated in a window, the collector electrode can be manufactured from a transparent conducting or semiconducting material such as a film of sputter-coating of metals, graphite on polymer materials or a layer of transparent conductive oxide such as aluminium doped zinc oxide, indium tin oxide, fluorine doped tin oxide, on a transparent insulating substrate such as glass.

The collector electrode may comprise various planar or non-planar shapes such as a plate, a wire mesh, a cylinder, a sphere, a parabolic shape, or portions thereof, or various irregular shapes, and the collector electrode has a greater dimension and if curved, a greater radius of curvature, than the emitter electrode.

Both emitter and collector electrodes may be arranged to generally form an arbitrary surface with various surface areas, however essentially the same minimum distance d should be maintained between every point of the corona electrode and the closest point over the collector electrode. Otherwise, the discharge will be concentrated in the regions presenting a shorter distance, leading to lower transducer efficiency and the risk to be more prone to arcing.

The operating DC voltage difference $U_{DC}$ between the electrodes preferably ranges between 1 to 30 kilovolts, preferably 5 to 15 kV, depending on the distance d between the corona electrode and the collector electrode, the output voltage of the power supply, and other operating parameters.

In embodiments of the invention, the distance d between the corona electrode and the collector electrode and maximal transducer operating voltage difference $U_{max}$ between the electrodes is chosen in order to satisfy the relation:

$$U_{max}/d=1.5\ \text{MV/m}-2\ \text{MV/m}.$$

In the case of an array of corona electrodes, they are preferably spaced equally from each other with minimal distance of 1.5*d and maximal of 3*d, otherwise the output power considerably decreases due to the mutual high potential influence reducing gas ionization, or due to a low number of electrodes.

The AC signal voltage amplitude $u_{AC}$ should satisfy several conditions:

$$u_{AC}+U_{DC}<U_{max},$$

$$U_{DC}-u_{AC}>U_0,$$

$$u_{AC}<0.1U_{DC},$$

where $U_0$ is the critical voltage difference when the corona discharge initiates.

The third relation constraining the AC voltage amplitude is advantageous but may be violated: $u_{AC}$ can be increased depending on the acceptable level of nonlinear distortion in the acoustic response of the transducer.

Keeping the same distance d between the electrodes while extending the operational surface secures the acoustic characteristics of the transducer. The proposed geometry guidelines allow manufacturing a transducer geometry that covers a large range of different shaped electrodes. Although conventional electrodynamic transducers are restricted to circular or elliptic shapes with a conical membrane, the proposed CD-based transducer can have many other shapes that allow it to be adapted to various installation structures for optimal noise reduction.

The number of electrodes is not necessarily restricted to two. Various combinations of electrodes number and shapes lead to a different acoustic behaviour of the transducer.

A first basic embodiment of the electroacoustic plasma transducer 5 is illustrated in FIG. 1. In this embodiment the electroacoustic plasma transducer 5 includes two electrodes where the planes containing the electrodes are parallel. The corona electrode 8 comprises a wire, and the collector electrode 9 comprises a perforated plate. In variants, the corona electrode may comprise an array of needles, or a blade, or an array of blades. In variants, the collector electrode may comprise a mesh, or a patterned layer of electrically conducting material on a substrate. The collector electrode is preferably substantially acoustically transparent in the operating range of frequencies of the active noise cancellation system 2. In the configuration of this embodiment, the transducer presents a sound source with a directivity pattern which corresponds to a combination of monopolar and dipolar radiation.

An alternative embodiment includes a second collector electrode placed symmetrically with the first collector electrode relative to the corona electrode plane. Such a transducer has an omnidirectional radiation in the frequency range, in which the thickness of the transducer is smaller than the sound wavelength. If one of the collector electrodes is made of a solid sound reflecting material such as a metallic plate, the emitted sound power at the opposite side is doubled. Transducers with the above mentioned specifications provide the generation of a homogeneous flow, which propagates orthogonally to the collector electrode plane. In this case the transducer is suitable for a sound manipulation device which works with plane sound waves.

In an embodiment, the transducer may comprise an enclosure 4 configured to enclose the electrodes 8, 9 on one side. In the case of a rigid enclosure 4 the sound radiated towards a backing wall 21 of the enclosure is fully or partially reflected and further summed with the radiation toward the open side 22. It is preferable that the backing wall 21 follows the shape of the collector electrode 8 and that its surface is parallel to the collector electrode surface. If the distance between the backing wall 21 and the collector electrode 8 varies, the time delay of reflected signal is different along the surface, resulting in an inhomogeneous phase shift in the transducer's emitted sound, thus varying radiation patterns.

In the case of the monopolar configuration of the transducer the frontward and backward radiated signals have the same phase. With one side enclosed, the sound is amplified (compared to the case without enclosure) up to the frequency:

$$f_{max} < c_{air}/\text{depth}/8,$$

where $c_{air}$ is the sound speed in air, depth is the distance between the backing wall 21 and a centre point between transducer's electrode planes. At the frequency $2f_{max}$ the frontward-radiated and backward-reflected sound completely cancel out the total signal.

In an embodiment, the collector electrode of a monopolar transducer type can be used as the enclosure backing wall if it is made from a solid conducting material, such as a metallic plate. Thus, the parameter depth can be reduced to few millimeters, leading to sound amplification up to 5-10 kHz.

In an embodiment comprising a dipolar electrode, the frontward and backward radiations have opposite phases. By enclosing one side, the total radiated sound is strongly reduced in the low frequency range. The amplification of radiated sound is achieved around the frequency $f_c$:

$$f_c \cong c_{air}/\text{depth}/4.$$

The enclosure 4 can be designed in order to amplify the desired range of frequencies and to reduce the radiation of unwanted frequencies. The same reasoning can be extended to other 3D shapes with multipolar radiation patterns.

The control system 7 comprises an amplification circuit 13 connected to the electrodes 8, 9 to provide power to the electrodes, and a controller 12 connected to the amplification circuit to control the output of the amplification circuit driving the electrodes. The control system may further comprise a sensing system connected to the controller, which may in particular comprise a microphone, or a plurality of microphones. The microphone or at least some of the plurality of microphones, are arranged to capture an acoustic signal between the electrode arrangement 6 and a source of sound to be reduced or cancelled, and to feed the captured signal to the controller for use in a feedback or feed forward control process. The controller 12 may comprise various computing configurations, for instance a dedicated microcontroller incorporated in electronics of the electroacoustic plasma transducer 5, or in the form of an external computing unit such as a personal computer connected to the electroacoustic plasma transducer 5 through an amplifier.

The amplification circuit 13 comprises at least one power supply 14 and a plurality of amplification channels. Each amplification channel is connected to an electrode arrangement formed of at least one corona electrode and one associated collector electrode.

According to an aspect of the invention, the active noise reduction system 2 comprises a plurality of electrode arrangements 6 that may be connected each to a different amplification channel with the same or different amplification parameters to control different electrode arrangements with the same or different frequency bandwidths and power. The term "electrode arrangement" as used herein is intended to mean an electrode pair formed by one corona electrode and one associated collector electrode, whereas the term "a plurality of electrode arrangements" as used herein is intended to mean any one of: a plurality of electrode pairs each formed by one corona electrode and one associated collector electrode; or

- one corona electrode and a plurality of collector electrodes associated therewith, where the collector electrodes are configured to be connected to individually controlled potentials; or
- one collector electrode and a plurality of corona electrodes associated therewith, where the corona electrodes are configured to be connected to individually controlled potentials.

This advantageously allows the active noise reduction system 2 to comprise a plurality of electrode arrangements assembled together to cover a large surface area and/or to reduce noise over a large frequency spectrum, including low frequency sound, in particular below 100 Hz and high frequency sound above 1 kHz. The plurality of electrode arrangements assembled together also advantageously allow the provision of an electroacoustic plasma transducer 5 with various 3D shapes.

The electroacoustic plasma transducer 5 requires a high voltage supply. In conventional systems this typically involves a high number of transformers connected in series in order to achieve the required voltage amplitude. This provides a high electrical power delivered to a single transducer, but with the drawback of providing a cumbersome power source. Moreover, in conventional systems, it is proposed to have a high frequency modulation in order to deliver the electrical power, which can potentially create electromagnetic interferences, likely to disturb sensors (for example microphones) in the vicinity of the transducer.

For sound reduction purposes, according to an aspect of the present invention, it is advantageous to provide a plurality of rather low power consuming and individually controlled transducers. The proposed amplification circuit is designed to feed a plurality of electrode arrangements with individual signals, while being lighter and presenting a more compact form factor. Moreover such arrangement reduces possible electromagnetic interference.

In embodiments of the present invention, the number of channels of the amplification circuit may vary depending on the number of transducers required for the application (actuator size vs. wavelength of operation for instance).

Figure 5A:
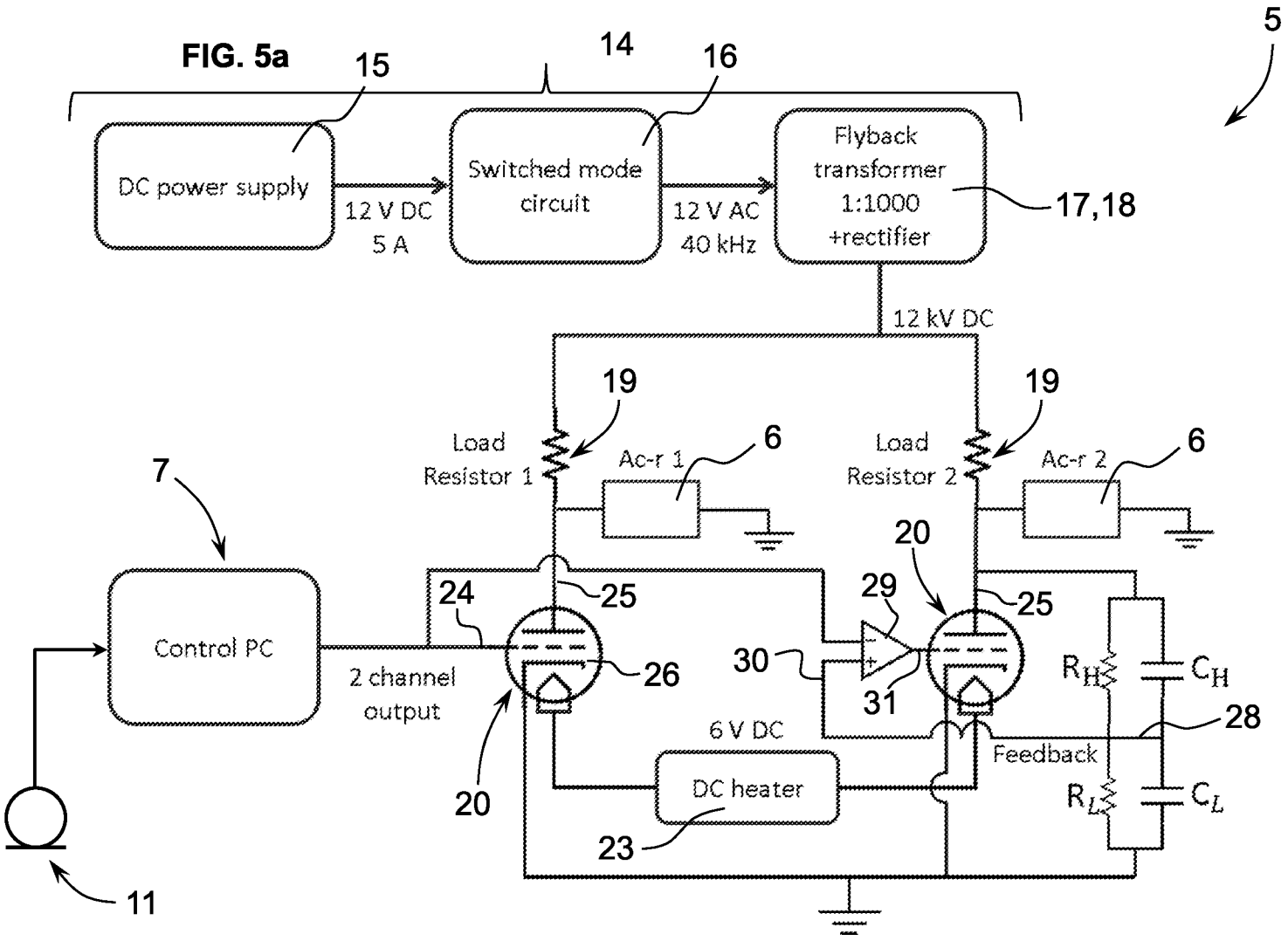
FIG. 5*a* is a simplified block circuit diagram of an active noise reduction system according to an embodiment of the invention.

An example of an embodiment of a multi-channel high voltage amplification circuit 13 is illustrated in FIG. 5*a*. In this example four channels are illustrated, however more or less channels may be provided, it being understood that the four channels merely represent an example of a multichannel embodiment.

The at least one amplification channel may advantageously comprise a load resistor 19 and a vacuum tube 20.

The at least one power supply advantageously comprises a DC power supply 15, a switched mode circuit 16 connected to and fed by the DC power supply, a transformer 17 connected to the output of the switched mode circuit and a rectifier connected to the transformer. Switching transistors of the switched mode circuit generate an alternating signal. Since their state is either on or off, such type of circuit is advantageously energy efficient. The output signal of the switched mode circuit powers the transformer. In an advantageous embodiment, the transformer may comprise a flyback transformer. The transformer 17 increases the input voltage which is further rectified by the rectifier. Since rectification is never ideal, a high frequency component from the oscillator circuit remains in the voltage output of the rectifier, whereby the adverse effects thereof may be reduced by configuring the switched mode circuit to operate at a relatively high frequency, chosen sufficiently greater than the audible range e.g. greater than 20 kHz, for instance around 40 kHz.

The amplified high DC voltage is applied to each channel to power each electrode arrangement 6.

The control system 7 outputs the individual low voltage control signals which should be amplified before reaching the electrode arrangements.

In a preferred configuration the AC voltage amplification part is based on vacuum tubes 20. This solution provides a cost effective and technologically simple way to amplify a voltage signal. Additionally, it is lighter and free from a possible electro-magnetic interference compared to a transformer. To provide a thermionic electron emission, the cathode of the tube is heated by a low voltage DC or AC source 23.

A constant anode-cathode electrical current is induced by connecting the high DC voltage from the flyback transformer output to the anode 25 of the vacuum tube 20 while the low potential is connected to the cathode 26 of the vacuum tube 20. The modulation of the current is created by connecting the voltage signal from the control system 7 to a control grid electrode 24 of the vacuum tube 20.

The load resistor 19 is placed between the flyback transformer and the anode 25 of the vacuum tube 20 for the generation of the high AC voltage output signal. The output high AC voltage component equals to the product of the load resistance and the amplitude of anode current change. The high DC voltage component feeding the electrode arrangement is equal to the difference of DC voltage supply (12 kV in the example) and the constant voltage drop in the load resistor 19. Thus, both amplification factor of AC signal and bias voltage of the electrode depend on the choice of the load resistor, which should be chosen according to the expected electrical load of the plasma transducer 5.

Feedback may be added from the output of the vacuum tube 20 via a feedback line 28 to the vacuum tube input in order to realize an amplifier that is load independent and has a linear frequency response as illustrated on the second output channel (the right side in FIG. 5*a*). The feedback voltage signal can pass a voltage divider comprising resistors and capacitors $R_H$, $R_L$, $C_H$, $C_L$. Any of the resistors or capacitors can be represented by series or parallel combination of the components in order to obtain a needed resistance or capacitance. The magnitude of DC voltage at the feedback line 28 compared to the voltage at the output 20 of the tube is then $R_L/(R_H+R_L)\approx R_L/R_H$ if $R_H \gg R_L$. The magnitude of AC voltage at the feedback line 28 compared to the voltage at the output 20 of the tube is then $C_H/(C_H+C_L)\approx C_H/C_L$, if $C_L \gg C_H$. For instance, if $R_H$=100 MOhm, $R_L$=100 KOhm, $C_H$=3 pF, $C_L$=3 nF, the divider ratio is close to 1000:1 in the whole frequency spectrum.

The divider ratio fixes the amplification gain of the amplifier which is not dependent on the load resistor 19 anymore (Load Resistor 2 in FIG. 5*a*). The feedback signal can be connected to the noninverting input 30 of an operational amplifier 29. The output 31 of the operational amplifier is connected to the control grid of the tube 20. If the control signal containing bias DC signal and AC signal feeds the inverting input 30 of the operational amplifier, the resulting voltage on the tube output 25 and therefore on corona electrode 9 of the transducer 5 is amplified by the divider ratio, for instance by 1000 using the numerical example discussed in the previous paragraph.

The embodiment illustrated in FIG. 5*a* shows an example of a high voltage amplifier implementation to power four transducers which consume maximum 10 W of electrical power. As a typical switched mode circuit and flyback transformer can sustain up to 150-200 Watts of power, the DC power supply 15 is a power limiting element in the circuit and should be dimensioned accordingly. On the other side the choice of the tube vacuum valve determines the maximal power supplied to a single electrode arrangement. Since the internal resistance of a high voltage tube is comparable to the resistance of a plasma actuator, in case of a failure of an electrode arrangement (e.g. shorting by an arc) the circuit current is limited by the tube, thus preventing damage to the amplification circuit components.

Figure 4:
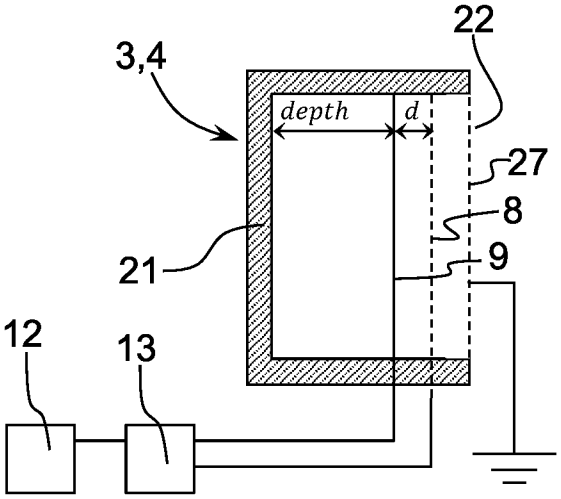
FIG. 4 is a schematic simplified cross-sectional view of an electroacoustic plasma transducer of an active noise reduction system according to an embodiment of the invention.
Figure 5B:
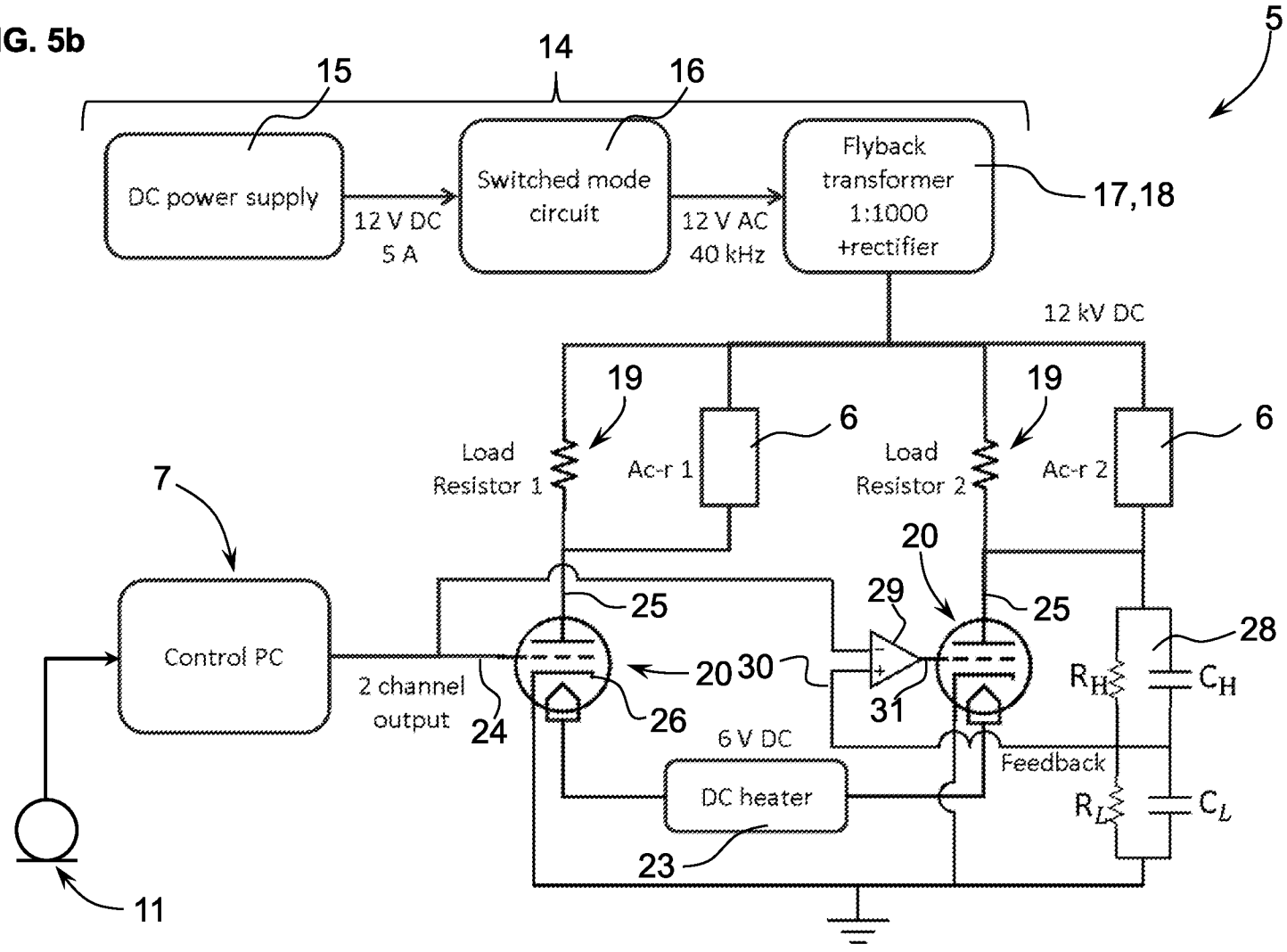
FIG. 5*b* is an illustration similar to FIG. 5*a* of a variant.

In another embodiment of a multichannel amplification circuit 13 illustrated in FIG. 5*b*, the AC voltage output of a channel is connected to the collector electrode of the electrode arrangement. This allows using a vacuum tube which operates at a lower voltage than in the embodiment in which the DC and AC channel voltage output is connected to the corona electrode. The output voltage may for example be in a range of 1-5 kV depending on the AC voltage amplitude needed. Since in this configuration the collector electrode 8 cannot be grounded, an additional grounded electrode 27 may be located on the other side of the collector electrode 8 from the corona electrode 9, for instance as illustrated in FIG. 4 in order to prevent hazards with high voltage. The necessary voltage difference for the electroacoustic plasma transducer is generated between the output of the transformer 17 (for instance 12 kV DC in the embodiment of FIG. 5*b*) and the vacuum tube 20. Feedback may be added from the output of the vacuum tube 20 via a feedback line 28 to the vacuum tube input in the same way as in the previous embodiment in FIG. 5*a*.

In variants, high voltage power MOSFET transistors may be used instead of vacuum tubes.

Figure 5C:
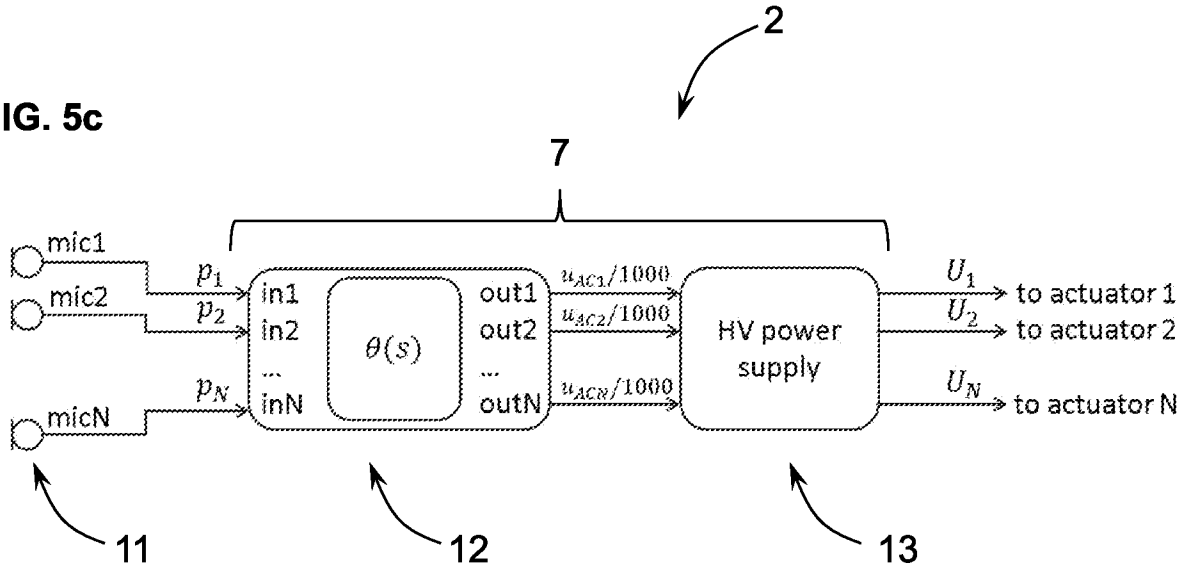
FIG. 5*c* is a block diagram of an active noise reduction system according to an embodiment of the invention.
Figure 6:
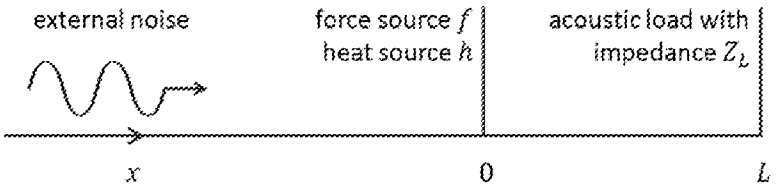
FIG. 6 is a graphical illustration of a one dimension schematic of an acoustic source and boundary positions of an active noise reduction system according to an embodiment of the invention.

The number of amplification circuit channels and associated electrode arrangements can vary depending on the application of the device. The acoustic pressure in front of the electroacoustic plasma transducer may be measured by a microphone 11 on the sound reducing side of the transducer. The control system may be configured to control the transducers with a feed forward method if the analytical model of the transducer is known (discussed herein further on), which allows using a single pressure sensing microphone to control one transducer. The pressure signal sensed in the vicinity of each electrode arrangement by the microphone 11 is fed into the controller 12 which is configured to filter it with a control transfer function $$\theta(s) = \frac{u_{AC}(s)}{p(s)}$$

as illustrated in FIG. 5*c*. The controller 12 outputs the AC component $u_{AC}(s)$ of the voltage applied to the electrodes in order to create a desired acoustic condition, for instance sound absorption, sound reflection, pressure cancellation, or other acoustic impedance conditions, at the position of the microphone 11.

The controller output voltage $u_{AC}(s)$ should be scaled down to compensate the amplification factor of the high voltage power supply (by a factor 1000 in the example illustrated in FIG. 5*c*). Additionally, without scaling down, the AC voltage $u_{AC}(s)$ is likely to exceed the typical controller output voltage limits. The controller preferably runs at a sampling frequency 10 times greater than the highest frequency of interest. The high voltage supply amplifies back the AC component and adds a DC bias. The total voltage difference $U(s)=U_{DC}+u_{AC}(s)$ is further applied to the electrode arrangement 6.

The electroacoustic plasma transducer 5 can be placed in different acoustic environments, of different sizes, and enclosed or not enclosed. In this case the pressure signal should be multiplied by the individual transfer function which takes into account the aforementioned conditions.

The feedback system is not able to provide optimal sound absorption over a wide frequency range. For this purpose, in an embodiment, the control system 7 may include a feed-forward scheme which allows achieving a target condition with a lower number of microphones and shorter latency.

The control transfer function θ(s), which contains the model of the transducer and the desired acoustic condition to achieve in the form of a target acoustic impedance, converts the pressure signal acquired by the microphone in the vicinity of electroacoustic plasma transducer into an electrical voltage signal $u_{AC}(s)$ which is fed to the amplification circuit. The model of the transducer considers corona discharge transducer as a combination of two processes, which eventually produce sound: heat release and force generation. It takes into account that the electroacoustic plasma transducer of the noise reduction system can be placed in different acoustic environments, which may be of different sizes, and may be enclosed or not enclosed. The voltage $u_{AC}(s)$ drives the electroacoustic plasma transducer to achieve a target frequency-dependent acoustic impedance at the position of the microphone. This target condition may be set to achieve sound absorption, sound reflection, partial reflection/absorption, or pressure cancellation, depending *inter alia* on the chosen impedance in the control transfer function θ(s).

Further an example of control transfer function θ(s) is presented in order to achieve a perfect sound absorption under the normal incidence of sound waves.

The corona discharge can be modelled as the combination of a heat and a mechanical force acoustic sources. Since the thickness d of the discharge region in the device is typically small compared to the wavelength in the audible range, and both heat and force are homogeneously distributed over the discharge area, the transducer can be considered as a point source in one dimensional space, with the axis perpendicular to the electrodes plane.

The one dimensional continuity equation reads:

$$\frac{\partial \delta}{\partial t} + \rho_0 \frac{\partial v}{\partial x} = 0. \tag{1}$$

In equation (1) $\rho_0$ is the undisturbed gas density, $\delta=\rho-\rho_0$ is the density fluctuation. The Newton's equation with a force density $$f\left[\frac{H}{m^3}\right]$$

is:

$$\rho_0 \frac{\partial v}{\partial t} + \frac{\partial p}{\partial x} = f \tag{2}$$

The energy conservation equation with the heat power density $$h\left[\frac{W}{m^3}\right]$$

reads:

$$\rho_0 T_0 \frac{\partial \sigma}{\partial t} = h, \tag{3}$$

where $\sigma=S-S_0$ is a change of entropy per unit mass, $T_0$ is the static ambient gas temperature. Considering the ideal gas with adiabatic transformations, the system closes with the equation:

$$\delta=\left(\frac{\partial\rho}{\partial P}\right)_S p+\left(\frac{\partial\rho}{\partial S}\right)_P \sigma=\left(\frac{1}{c^2}\right)p-\left(\frac{\rho_0}{C_P}\right)\sigma, \tag{4}$$

where c is the speed of sound in the gas, and $C_P$ the heat capacity per unit mass.

From (1) and (4), the density variation can be eliminated:

$$\frac{1}{c^2}\frac{\partial p}{\partial t}-\frac{\rho_0}{C_P}\frac{\partial\sigma}{\partial t}+\rho_0\frac{\partial v}{\partial x}=0 \tag{5}$$

Combining (3) and (5) the entropy variation is removed from the equation:

$$\frac{1}{c^2}\frac{\partial p}{\partial t}-\frac{1}{C_P T_0}h+\rho_0\frac{\partial v}{\partial x}=0 \tag{6}$$

Taking time derivative of equation (6) and space derivative of equation (2), excluding velocity from the system, the time domain wave equation for acoustic pressure is obtained:

$$\frac{1}{c^2}\frac{\partial^2 p}{\partial t^2}-\frac{\partial^2 p}{\partial x^2}=\frac{1}{C_P T_0}\frac{\partial h}{\partial t}-\frac{\partial f}{\partial x} \tag{7}$$

Alternatively, taking time derivative of equation (2), taking space derivative of equation (6) with multiplication by $c^2$, excluding acoustic pressure, the time domain wave equation is obtained:

$$\frac{1}{c^2}\frac{\partial^2 v}{\partial t^2}-\frac{\partial^2 v}{\partial x^2}=-\frac{1}{\rho_0 C_P T_0}\frac{\partial h}{\partial x}-\frac{1}{\rho_0 c^2}\frac{\partial f}{\partial t} \tag{8}$$

In the frequency domain, the wave equations (7) and (8) take the form:

$$\left(\frac{\partial^2}{\partial x^2}+k^2\right)p=-\frac{j\omega}{C_P T_0}h+\frac{\partial f}{\partial x} \tag{9}$$

$$\left(\frac{\partial^2}{\partial x^2}+k^2\right)v=-\frac{1}{\rho_0 C_P T_0}\frac{\partial h}{\partial x}+\frac{j\omega}{\rho_0 c^2}f \tag{10}$$

The total force generated by the corona discharge is directed from the emitter towards the collector electrode. It can be written as:

$$F=\frac{Cd}{\mu_i}(2U_{DC}-U_0)u_{AC}.$$

Here, d is the distance between the transducer electrodes, $\mu_i$ is the effective mobility of the positive ions at atmospheric pressure and given humidity, $U_{DC}$ is the bias voltage of the transducer, $u_{AC}$ is the AC voltage component responsible for sound generation. The other unknown constants are defined from voltage-current characteristics of the transducer which is approximated by the analytical formula: $I=CU(U-U_0)$, where $$C\left[\frac{A}{V^2}\right]$$

is a dimensional constant and $U_0$ is the critical voltage at which the discharge initiates. Note that if the transducer is designed in a monopolar geometry, which includes two symmetrically placed collectors, the cumulative force in the region between the electrodes equals zero.

The total heat power generated by the transducer is:

$$H=C(3U_{DC}^2-2U_{DC}U_0)u_{AC}$$

Assuming homogeneously distributed force and heat power, the total force F and heat power H relate to their densities as $$h=\frac{H}{S_e d},\ f=\frac{F}{S_e d},$$

where $S_e$ is the cross section area of the electrode arrangement.

Referring to FIG. 5, assuming that the transducer electrode arrangement is centered at the origin 0 of the x axis. The external acoustic excitation emanates from the left of the transducer electrode arrangement (negative x values), the back acoustic load of the transducer electrode arrangement (for example, hard wall, enclosure, or infinite medium), is located at the right (positive x values). The acoustic load is characterized by its impedance $Z_L$. In plane waves approximation any load impedance mismatch with the characteristic impedance of air $Z_c=\rho c$ yields sound reflection with reflection coefficient $r=(Z_L-\rho c)/(Z_L+\rho c)$.

Further all acoustic pressures and velocities are considered for negative coordinates x as the region of interest. The acoustic pressure $P_h$ generated by the heat source is found as the solution of equation (9) considering only the heat source on the right side. Taking into account a possible reflection from the acoustic load, the formula reads:

$$p_h=\frac{dc}{2C_p T_0}h(\exp(jkx)+r\exp(jk(x-2L))).$$

The corresponding acoustic velocity $v_h$ is:

$$v_h=-\frac{d}{2\rho C_P T_0}h(\exp(jkx)+r\ \exp(jk(x-2L))).$$

The force-induced sound pressure $p_f$ and velocity $v_f$ are derived similarly. The minus sign in reflected wave is there since the force is a dipolar sound source.

$$p_f=\frac{d}{2}f(\exp(jkx)-r\ \exp(jk(x-2L))),$$

$$v_f=-\frac{d}{2\rho c}f(\exp(jkx)-r\ \exp(jk(x-2L))).$$

The total acoustic pressure in the vicinity of the transducer is the sum of the heat, force pressure, and the pressure $P_{ac}$ created by an external acoustic excitation.

$$P_t=P_f+P_h+P_{ac}.$$

The same holds for acoustic velocity $$v_t=v_f+v_h+v_{ac}.$$

Velocity $v_{ac}$ can be expressed through the acoustic impedance at position x: $v_{ac}=P_{ac}/Z_{ac}(x)$. If the load impedance $Z_L$ is known, the acoustic impedance at distance L from the load (at the transducer position) is the following:

$$Z_{ac} = \rho c\frac{Z_L + j\rho c\tan(kL)}{\rho c + jZ_L\tan(kL)}.$$

Therefore, total acoustic velocity becomes:

$$v_t = v_f + v_h + \frac{p_t - p_f - p_h}{Z_{ac}}. \tag{11}$$

The sound reduction is based on the control of the acoustic impedance at position x and assigning it to the desired target value $Z_{tg}=p_t/v_t$. As an example, a target impedance with real value $Z_{tg}=\rho c$ corresponds to full sound absorption (r=0), the value $Z_{tg}=0$ corresponds to pressure release, yielding sound reflection r=−1 (full reflection with opposite phase shift), etc.

The control algorithm is as follows:

- the microphone in front of the transducer electrode arrangement provides the measurement of the total sound pressure $p_t$.
- the pressure $p_t$ is converted into electrical voltage $u_{AC}$ through the controller transfer function $u_{AC}=\theta\cdot p_t$.
- this output voltage controls the output acoustic velocity $v_t$ in such a way to satisfy a relation $Z_{tg}=p_t/v_t$.

In this cascade ($P_t\rightarrow u_{AC}\rightarrow v_t$), the model of the electroacoustic plasma transducer is essential to identify the transfer function, that allows achieving the target impedance $Z_{tg}=p_t/v_t$. Indeed, substituting the expressions of $p_f, v_f, p_h, v_h$ and target impedance to the equation (11) gives the formula for the transfer function θ:

$$\theta = \frac{1}{A}\left(1 - \frac{Z_{ac}}{Z_{tg}}\right),$$

where $$A = \frac{d}{2}\left(1 + \frac{Z_{ac}}{\rho c}\right)\left[\left(f_0 + \frac{ch_0}{C_pT_0}\right)\exp(jkx) + \left(-f_0 + \frac{ch_0}{C_PT_0}\right)r\ \exp(jk(x-2L))\right].$$

In A $f_0=f/u_{AC}$, $h_0=h/u_{AC}$ are the constants depending on the actuator and operating conditions. Since the distance between the transducer electrode arrangement and the microphone may be small (for instance less than 10 mm) compared to the wavelength in the audible range, the factor A can be processed with x=0.

$$A = \frac{d}{2}\left(1 + \frac{Z_{ac}}{\rho c}\right)\left[f_0 + \frac{ch_0}{C_PT_0} + \left(-f_0 + \frac{ch_0}{C_PT_0}\right)r\ \exp(-2jkL)\right].$$

Under normal incidence, the target impedance can be generalized as $Z_{tg}=n\rho c$, where $n\in(0,+\infty)$. If n tends towards infinity, the target impedance corresponds to the case of a hard wall condition which implies a reflection of incident acoustic waves. On the other side, lowering n towards zero leads to a small target impedance which approaches a pressure cancellation condition. The case with n=1 corresponds to the sound absorption under normal sound incidence. With $Z_{tg}=n\rho c$ as a target impedance the transfer function θ becomes $$\theta = \theta_1/\theta_2,\ \theta_1 = \frac{\left(Z_L - \frac{\rho c}{n}\right)\left(\frac{n\rho c - Z_L}{nZ_L - \rho c} + j\tan(kL)\right)}{(Z_L + \rho c)(1 + j\tan(kL))},$$

$$\theta_2 = f_0 + \frac{ch_0}{C_PT_0} + \left(-f_0 + \frac{ch_0}{C_PT_0}\right)r\ \exp(-2jkL).$$

Stable transfer function in the s domain is obtained by first order approximation of the tangent function and second order approximation of the exponential.

$$\theta_1 = \frac{\left(Z_L - \frac{\rho c}{n}\right)\left(\frac{n\rho c - Z_L}{nZ_L - \rho c} + \frac{Ls}{c}\right)}{(Z_L + \rho c)\left(1 + \frac{Ls}{c}\right)},$$

$$\theta_2 = f_0 + \frac{ch_0}{C_PT_0} + \left(-f_0 + \frac{ch_0}{C_PT_0}\right)r\frac{1 - \frac{Ls}{c} + \frac{L^2}{2c^2}s^2}{1 + \frac{Ls}{c} + \frac{L^2}{2c^2}s^2}.$$

The transfer function is used in the active noise reduction system 2 in order to set different acoustic conditions depending on the intended application. It may be individual to every manufactured electroacoustic plasma transducer.

To obtain the control transfer function and configure the control system, the following generalized procedure may be undertaken.

a. Estimation of parameters of the transducer model and storing them in the memory of controller. These may include:
   - geometrical parameters such as distance d between the corona electrode and the collector electrode, the cross section area of the electrode arrangement $S_e$, distance L from the center of electrode arrangement to the enclosure (if there is any). These parameters can be obtained by direct measurements.
   - back impedance $Z_L$ corresponding to the presence of enclosure on the transducer. This parameter can be measured e.g. in the impedance tube, or modelled in a computer simulation.
   - environmental parameters such as ambient gas temperature $T_0$, sound speed in gas c, gas mass density ρ. These parameters can be obtained by direct measurements or taken from tables.
   - discharge parameters such as effective ion mobility $\mu_i$, that can be found in the literature [18] or measured.
   - discharge parameters such as critical corona voltage $U_0$, and dimensional constant C. They can be obtained after a specific identification procedure, since they are unique to every transducer and vary depending on transducer geometry or environment. To estimate $U_0$ and C, voltage-current characteristics of a particular transducer in a given environment may be measured. Applying different constant voltages U the constant electrical current I between the electrodes is recorded. For the data points where current is not zero, the recorded curve can be fitted with formula $I=CU(U-U_0)$. From the fit parameters $U_0$ and C can be obtained.

b. A target, frequency-dependent complex acoustic impedance $Z_{tg}$ (ω) may be chosen which defines a desired acoustic condition to achieve. It can be chosen freely, but an optimal value (eg. for optimal sound absorption) depends on the environment the noise reduction system is put. The optimal value can be measured or simulated in simple environments such as ducts or found empirically in more complex environments.

c. Combining the transducer model and the back impedance model of step (a), and the target impedance model of step (b), allows to obtain the target control transfer function θ(s) for each individual transducer. Since the model is linear, the control transfer function θ(s) may be built in the Laplace domain (s=jω).

d. Implement, in the control system, the transfer function θ(s) for each plasma transducer, for instance in the form of an Infinite Impulse Response (IIR) filter. The output voltage signal $u_{AC}(s)$ of the IIR filter is fed to the amplification circuit that is further connected to the corresponding electrode arrangement.

Figure 3:
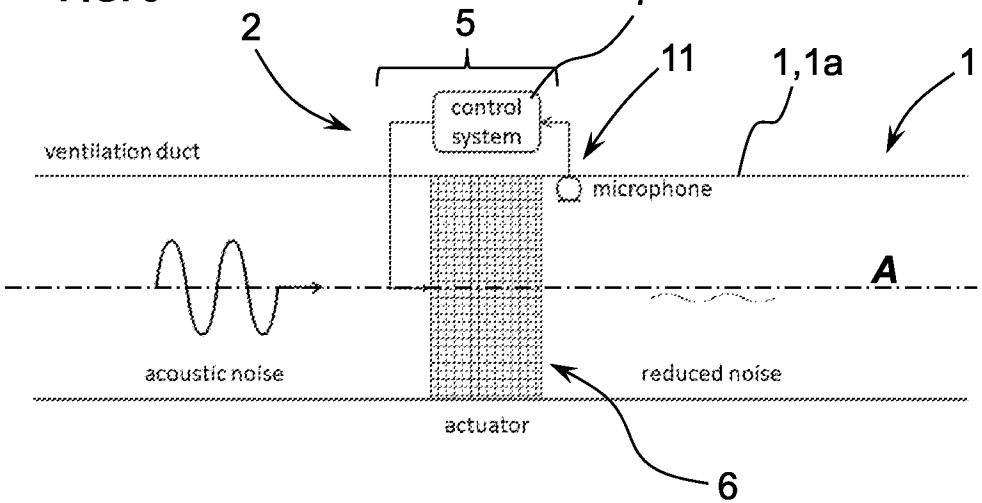
FIG. 3 is a schematic simplified cross-sectional view of an active noise reduction system according to an embodiment of the invention installed in an installation structure formed of a ventilation or exhaust duct.

In the case of noise propagation in long ducts such as ventilation, air conditioning and flow carrying systems, the device can benefit from a broadband plasma-based noise reduction system. The proposed noise reduction system can be an alternative to conventional acoustic baffle silencers, that lack efficiency at low-frequencies. Such plasma-based noise reduction solution can be either used in a grazing incidence configuration (as in a conventional acoustic baffle silencer) but with significantly smaller depth to tackle low-frequencies, or under normal incidence, provided the free (open) area of the plasma transducer is set to not disturb the mean air flow (FIG. 3, discussed later). Each plasma solution can apply to either rectangular or circular duct cross-section (as in FIG. 1*f*).

As an example, for a rectangular duct of 50×50 mm2 cross section the absorber with the following parameters is installed along the duct wall:

50×50 mm2 rectangular actuator, interelectrode distance d=6 mm, backed with a rigid termination $$(Z_L = 10^5\left[\frac{kg}{m^2 s}\right],$$

r≈1) at distance L=20 mm, with a sensing microphone at 5 mm in front of the electrode arrangement.

Estimated voltage-current characteristics of the form $$I = CU(U-U_0) = 2.2\cdot 10^{-11}\left[\frac{A}{V^2}\right]U(U-6190[V]),$$

with operating voltage $U_{DC}$=8200 [V].

Effective ion mobility $$\mu_i = 1.1\cdot 10^{-4}\left[\frac{m^2}{sV}\right]$$

for average humidity 30-60% at the atmospheric pressure. Air density $$\rho = 1.23\left[\frac{kg}{m^3}\right],$$

speed of sound $$c = 343\left[\frac{m}{s}\right],$$

average temperature $T_0$=20 [C° ], air heat capacity $$C_P = 1015\left[\frac{J}{kgK}\right].$$

Target impedance $Z_{tg}$=(0.11−1i*0.09)*f as the optimal for sound absorption under grazing incidence in a duct with height 50 mm, f—frequency in Hz.

If all the parameters are inserted in the formula for transfer function θ, the following continuous transfer function is obtained:

$$\theta = \frac{b_0 s^2 + b_1 s + b_2}{s^2 + a_1 s + a_2},$$

Where $b_0$=2.13e2 [$s^{-2}$], $b_1$=−1.66e6 [$s^{-1}$],$b_2$=5.70e9, $a_1$=2.45e3 [$s^{-1}$], $a_2$=0.3.

If the sampling frequency of the controller is 50 kHz, the discrete time transfer function in z domain can be obtained and integrated in a controller:

$$\theta = \frac{191.9 - 414z^{-1} + 224.3z^{-2}}{1 - 1.952z^{-1} + 0.9521z^{-2}}.$$

It works as a digital filter where the input signal is the front pressure in Pascals sensed by a microphone, and the output is the ac component of the voltage $u_{AC}$, which should be summed to the dc component $U_{DC}$=8200 [V] and applied to the electroacoustic plasma transducer to absorb sound.

Another example relates to noise reduction in rooms and spaces of medium size where the plasma-based active noise reduction system according to an embodiment is placed in the corner of the room. The following specifications are provided as an example:

300×400 mm2 rectangular actuator, interelectrode distance d=9 mm, backed with a rigid termination, $$(Z_L = 10^5\left[\frac{kg}{m^2 s}\right],$$

r≈1) at distance L=150 mm, with a sensing microphone at 5 mm in front of the electrode arrangement.

Estimated voltage-current characteristics of the form $$I = CU(U-U_0) = 3.4\cdot 10^{-10}\left[\frac{A}{V^2}\right]U(U-8970[V]),$$

with operating voltage $U_{DC}$=12000 [V].

Effective ion mobility $$\mu_i = 1.1 \cdot 10^{-4}\left[\frac{m^2}{sV}\right]$$

for average humidity 30-60% at the atmospheric pressure. Air density $$\rho = 1.23\left[\frac{kg}{m^3}\right],$$

speed of sound $$c = 343\left[\frac{m}{s}\right],$$

average temperature $T_0$=20 [C°], air heat capacity $$C_P = 1015\left[\frac{J}{kgK}\right].$$

Target impedance $Z_{tg}$=0.25ρc for damping low frequency noise in the space.

Continuous time transfer function of third order can be obtained by approximation of the analytical function:

$$\theta = \frac{b_0 s^3 + b_1 s^2 + b_2 s + b_3}{s^3 + a_1 s^2 + a_2 s + a_3}, \text{ where } b_0 = 1.088e3[s^{-3}],$$

$$b_1 = -4.99e6[s^{-2}],\ b_2 = -3.42e10[s^{-1}],\ b_3 = -1.04e14,$$

$$a_1 = -2.48e4[s^{-2}],\ a_2 = 6.18e7[s^{-1}],\ a_3 = 2.39e10.$$

Discretized transfer function at 50 kHz sampling frequency:

$$\theta = 824.85\frac{(z-1.202)(z^2-1.909z+0.9126)}{(z-0.9553)(z-0.9905)(z-0.6395)}.$$

According to an embodiment, the active noise reduction system 2 may form a multipolar sound source. The flexibility offered by the transducer electrode arrangement geometry can be used to create a multipolar radiating source. This embodiment can have a spherical geometry as illustrated in FIG. 1*c*. An internal spherical dielectric support frame 10 supports a corona electrode 9. It could be manufactured from an array of needles, or array of wires strung on the dielectric spherical frame 10. The collector electrode 8 may be in the form of a second sphere of greater diameter concentrically located around the internal spherical dielectric support frame. The collector electrode may be in the form of a perforated metal sphere, a spherical wire mesh, or other electrically conducting and sound penetrable material arranged in a sphere. Such a transducer can be considered as a substantially ideal three dimensional omnidirectional sound source. It can be used as a spherical wave radiator. If the total size is small compared to the radiated sound wavelength, its behaviour approximates a perfect point source.

In a variant, the collector electrode 8 comprises sectors 8*a*, 8*b*, 8*c*, 8*d* where the electrical potential is controlled independently. If the AC voltage difference $u_{AC}$ between the corona electrode 9 and the collector electrode sectors 8*a*, 8*b*, 8*c*, 8*d* has the same amplitude and phase, the case is similar to the previous embodiment and the transducer has a monopolar directivity. In a variant with a pair of half sphere sectors, if the AC signal $u_{AC}$ has the same amplitude but 180 degrees phase shift for two opposite half-spheres of the collector electrode, the sound radiation is dipolar. In a variant where the collector electrode is formed of four equal symmetric quarter-sphere sectors, if the AC signal $u_{AC}$ has the same amplitude but 180 degrees shift between any two closest sectors, this case is equivalent to the operation of two dipoles in opposite phase, thus, generating a quadrupolar signal. FIG. 1*c* illustrates an example of a spherical corona discharge transducer presenting a collector electrode divided in 8 equal sectors. One sector is removed for illustrative purposes.

In an alternative embodiment, the corona electrode may be formed of individual sectors where the electrical potential is controlled independently.

According to another embodiment, the sound radiating sectors of the electroacoustic plasma transducer may be formed by individual electrode arrangements formed of a pair of electrodes—one corona electrode and one collector electrode—where the individually controlled electrode arrangements are assembled together to form a 3D shaped transducer.

The multisector variants may advantageously be extended to realize virtually any multipolar sound source.

Other 3D shapes of multipolar sound sources based on the principles of the foregoing variants with a plurality of sectors are possible, for example cylindrical, parallelepiped, pyramidal and other multifaceted 3D shapes.

In embodiments, the active noise reduction system 2 may be used for sound absorption purposes. The system can be implemented in ducts, for instance ventilation ducts, in order to absorb unwanted acoustic noise, in rooms to reduce the reverberation and/or to equalize the acoustic modal behavior at low frequencies, or in other installation structures such as noise barriers for transportation noise, acoustic partitions for office cubicles, and casings for loud machines.

The active noise reduction system 2 may comprise one or a plurality of electroacoustic plasma transducers 5, each transducer comprising an electrode arrangement or a plurality of electrode arrangements or electrode arrangement sectors, and a control system with a multichannel amplification circuit 13 and one or more microphones 11. A multichannel arrangement allows to absorb an incident sound over a wide frequency range. The typical thickness of the electrode arrangement may be approximately 100 times smaller compared to the wavelength of the lowest frequency it can absorb, which is very compact compared to passive absorbing materials or electrodynamic loudspeaker technologies. The highest frequency of absorption can be limited by the enclosure thickness, transducer size, approximations made in the transfer function, delays in the control system and its sampling rate.

For an active noise reduction system 2 acting on the sound field on one side of the electrode arrangement and absorbing plane waves, a preferred geometry comprises flat or almost flat electrode arrangements. In this case, the transfer function is simple to design. The planar transducer inherently generates sound in both directions normal to the electrode plane. To absorb sound in front and not disturb the back sound field, the transducer should be enclosed on the back side.

Figure 1B:
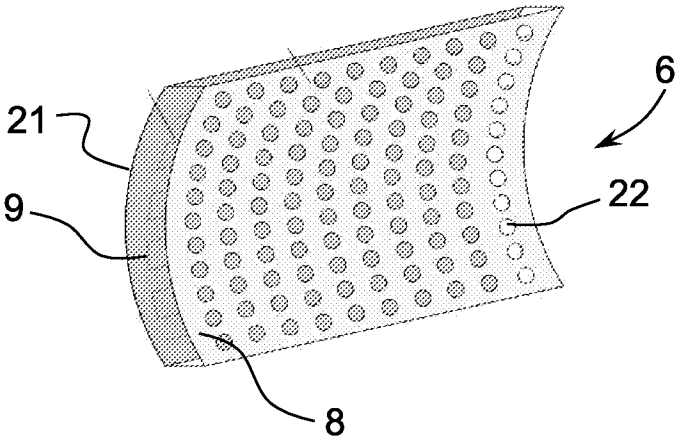
FIG. 1*b* is a schematic simplified view of a curved electrode arrangement of an active noise reduction system according to another embodiment of the invention.
Figure 1D:
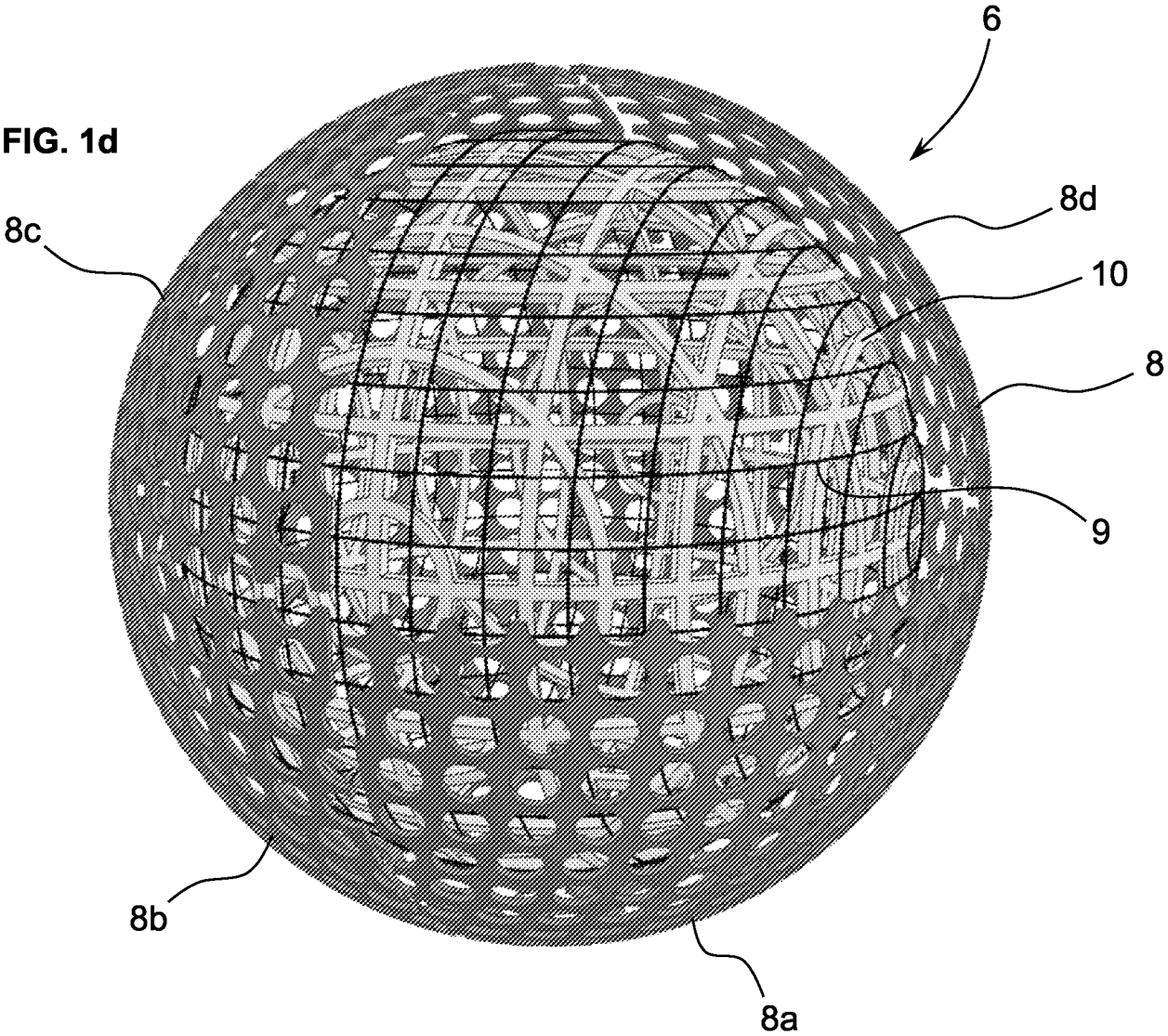
FIG. 1*d* is a simplified schematic perspective view of an electrode arrangement of an active noise reduction system according to another embodiment of the invention.
Figure 1F:
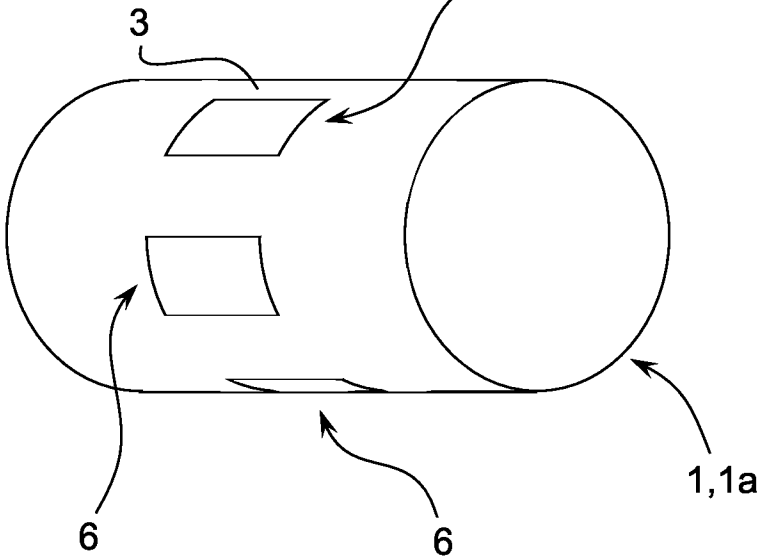
FIG. 1*f* is a simplified schematic view of an active noise reduction system 2 installed on a duct according to another embodiment of the invention.
Figure 1E:
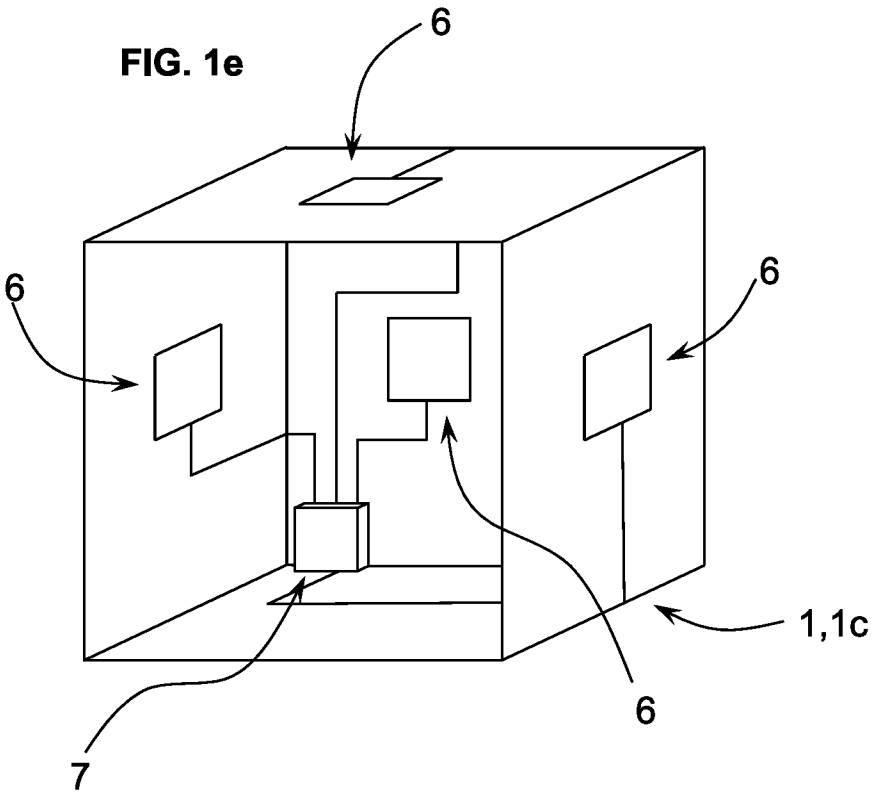
FIG. 1*e* is a simplified schematic perspective view of an active noise reduction system according to an embodiment of the invention mounted in an installation structure such as a room or a cabinet.

In variants, the electrode arrangement may have a curved shape, for instance as illustrated in FIG. 1*b*, to conform to the installation structure, for instance for installation in aircraft turbine engine liners.

If the active noise reduction system 2 is used in three dimensional space such as rooms, the microphone should preferably be placed in a center of a sound reduction side of the collector electrode of the electrode arrangement. This allows to have a minimal possible control delay and measure the average pressure on the sound reduction side of the electroacoustic plasma transducer.

In embodiments where the installation structure is a duct, in which mainly plane waves propagate, the microphone can be flush mounted in the duct wall.

The transfer function may be implemented based on a target impedance determined empirically or by computer simulation as optimal for absorption in the installation structure.

In installation structures comprising ducts, the identification of the optimal impedance may be linked to the ratio of cross-section between the duct and the transducer, and the characteristic impedance $Z_c$. In more complex spaces such as rooms, an optimal impedance may be rather difficult to derive or model analytically. In such cases, the optimal impedance for the transfer function may be chosen empirically, for instance by iteratively changing the value of $Z_{tg}$ in transfer function θ and assessing the performance experimentally, or by computer simulation, for instance by 3D computer modelling of the room and sound transmission characteristics, to identify the optimal impedance for the transfer function.

The number of the electrode arrangements in the active noise reduction system 2 may vary in different cases. In the duct under normal incidence, one single transducer covering the whole cross section may suffice. However, for damping room modes at low frequencies several transducers can be placed in the room corners or room walls. A plurality of electrode arrangements may be used to increase efficiency of sound absorption in three dimensional space.

As an alternative to the sound absorption, the active noise reduction system 2 can be configured to control the amount of reverberation in the room at higher frequencies. If a space needs to sound more reverberant, the system can be configured to reflect more sound than the passive walls do.

In an embodiment, the active noise reduction system 2 can be implemented as an acoustic liner for noise reduction, for example, for aircraft engine noise reduction. It is well suited for such applications compared to known active methods:

- due to the absence of moving parts, that are likely to be damaged by harsh environments,
- due to its compliance to hot temperatures
- due to its ability to adapt to curved shapes (cylindrical, etc.)

The electrode arrangement geometry may be curved, as illustrated in FIG. 1*b*, to conform to the shape of an aircraft engine nacelle. The target impedance $Z_{tg}$ in the transfer function can be adapted to perform more effective sound absorption in a wall-mounted configuration in the presence of a mean flow. The target impedance $Z_{tg}$ can be also implemented as a complex frequency dependent function and, while being stable, closely follow an optimal impedance for grazing incidence absorption, for example, as in [15], [16].

In another embodiment, the active noise reduction system 2 can be implemented as an active noise reduction system mounted in a window 1*b*.

The main problem with existing active window concepts employing loudspeakers within the frame of the window is the actual integration of the speakers, and the constraints linked to their miniaturization. Indeed the small size of the transducers (less than 2 cm diameter) impacts their dynamic response and prevent their use in the very low-frequency range, where most of the attenuation is needed.

The electroacoustic plasma transducer 5 according to embodiments of the invention can be employed to reduce noise transmission through windows since the sensitivity/frequency band of operation does not depend on the surface of the transducer.

Figure 2C:
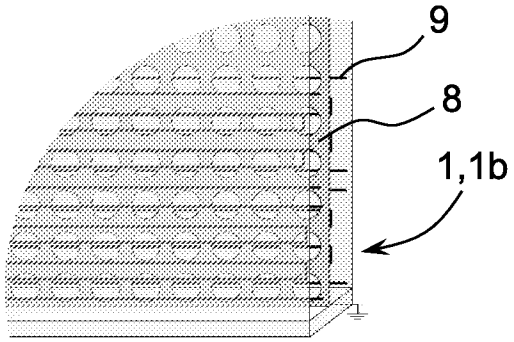
FIGS. 2*b* and 2*c* are views similar to FIG. 2*a* of variants.
Figure 2B:
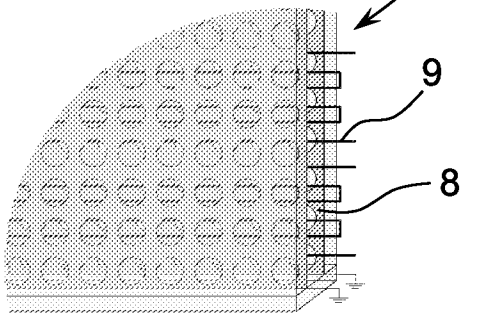
Figure 2A:
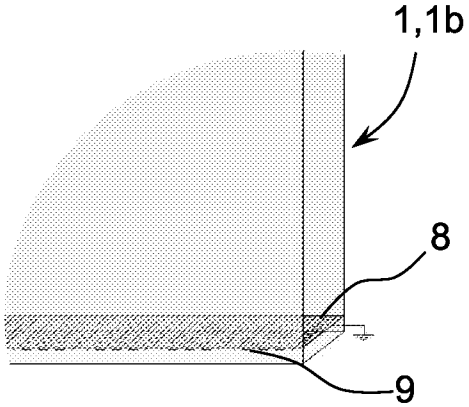
FIG. 2*a* is a schematic perspective view of a portion of an installation structure formed of a window in which an electrode arrangement of an active noise reduction system according to an embodiment of the invention is installed.

FIG. 2*a* schematically illustrates an embodiment of an active noise reduction system embedded in the window side frame. As an example, the corona electrode 9 is made of a wire array and the collector electrode 8 of a metal mesh or perforated plate. A single electrode arrangement 6 allows damping only a limited range of frequency acoustic modes. In order to be able to reduce noise of higher order modes, a plurality of electrode arrangements 6 may be installed, with different transfer functions to cover the desired range of frequency acoustic modes.

In a preferred configuration, more than one edge of the window, or all edges of the window, could be fitted with electrode arrangements. The electrode arrangement may either have a monopole configuration with two collector electrodes surrounding the corona electrode, or a dipole configuration with one collector electrode facing the plenum of the window, and the corona electrode positioned between the collector electrode and the frame of the window closing the plenum.

Since the control system 7 may be placed at a distance from the electrode arrangement, the appearance of the window may resemble a conventional window.

In another embodiment of a noise reduction system embedded in a window, the electrode arrangement 5 can be mounted parallel to the window panels. It is preferable to construct the electrode arrangement 5 in a monopole configuration because for dipolar geometry the sound reflection from glass panels may cancel out the sound emitted by the electroacoustic plasma transducer at low frequencies. A plurality of electrode arrangements may be stacked together side by side in order to be able to damp a large range of frequency modes propagating through window.

In FIGS. 2*b* and 2*c* two possible embodiments with monopolar configuration of the electrode arrangement are schematically illustrated. In the example of FIG. 2*b*, the collector electrode 8 has two plates or layers, one on either side of a corona electrode 9 formed by an array of wires. In the example of FIG. 2*c*, one collector electrode is placed between a corona electrode formed by two arrays of wires, one either side of the collector electrode. The porosity of the collector electrodes can be chosen to satisfy various transparency requirements. In a variant, the collector electrode may be a panel of a transparent conductor, or a thin transparent conductive layer, such as indium tin oxide, formed on the inner surface(s) of the glass pane(s) of the window.

In an embodiment, the active noise reduction system 2 can be implemented as an active noise reduction system mounted in a ventilation duct as schematically illustrated in FIG. 3. The electrode arrangement in this example is placed in the duct 1*a* with the plane of the electrode arrangement perpendicular to the duct axis A. The microphone 11 measures the noise disturbance in the ventilation duct and the control system 7 calculates and generates the voltage signal for the electrodes in order to minimize noise in the location of the microphone. Since mainly plane waves propagate in the ventilation duct, minimization of the noise signal at the microphone location ensures noise reduction in the whole duct after the electrode arrangement. The electrode arrangement is porous in order to allow airflow in the duct. In a variant, the electrode arrangement may have a diameter or surface area that only partially extends across the duct, allowing airflow around the electrode arrangement in addition, or instead of, the airflow through the electrode arrangement.

LITERATURE REFERENCES

[1] E. Rivet and S. Karkar, "Broadband Low-Frequency Electroacoustic Based Impedance Control," *IEEE Trans. Control Syst. Technol.*, vol. 25, no. 1, pp. 1-10, 2016.

[2] R. Boulandet *et al.*, "Duct modes damping through an adjustable electroacoustic liner under grazing incidence," *J. Sound Vib.*, vol. 426, pp. 19-33, 2018.

[3] A. J. B. Tadeu and D. M. R. Mateus, "Sound transmission through single, double and triple glazing. Experimental evaluation," *Appl. Acoust.*, vol. 62, no. 3, pp. 307-325, 2001.

[4] L. Bhan and G. Woon-Seng, "Active Acoustic Windows: Towards a Quieter Home," *IEEE Potentials*, vol. 35, no. 1, pp. 11-18, 2016.

[5] M. Sharifzadeh Mirshekarloo *et al.*, "Transparent piezoelectric film speakers for windows with active noise mitigation function," *Appl. Acoust.*, vol. 137, no. November 2017, pp. 90-97, 2018.

[6] W. Du Bois Duddell, "The musical arc," vol. 63, no. 162, 1901.

[7] K. Matsuzawa, "Sound sources with corona discharges *," vol. 494, no. 1973, 1973.

[8] F. Bastien, "Acoustics and gas discharges: Applications to loudspeakers," *J. Phys. D. Appl. Phys.*, vol. 20, no. 12, pp. 1547-1557, 1987.

[9] P. Bequin, K. Castor, P. Herzog, and V. Montembault, "Modeling plasma loudspeakers," *J. Acoust. Soc. Am.*, vol. 121, no. 4, pp. 1960-1970, 2007.

[10] A. R. M. Chambers, "Corona discharge loudspeaker," GB2403372A.

[11] K. D. Howard, "Corona discharge loudspeaker," GB2312590A.

[12] I. Krichtapovich, J. Charah, V. A. Korolev, N. E. Jewell-Larsen, and S. V Karpov, "ELECTROSTATIC LOUDSPEAKER AND METHOD OF ACOUSTIC WAVES GENERATION," WO 2007/127810 A2, 2009.

[13] S. Sergeev, H. Lissek, A. Howling, I. Furno, G. Plyushchev, and P. Leyland, "Development of a plasma electroacoustic actuator for active noise control applications," *J. Phys. D. Appl. Phys.*, vol. 53, no. 49, p. 495202, 2020.

[14] S. Sergeev, H. Lissek, "Corona discharge actuator for active sound absorption," Forum Acusticum, p. 1551-1555, 2020.

[15] F. Zotter and M. Frank, *Ambisonics: A Practical 3D Audio Theory for Recording.* 2019.

[16] B. J. Tester, "THE OPTIMIZATION OF MODAL SOUND ATTENUATION IN DUCTS, IN THE ABSENCE OF MEAN FLOW," *J. Sound Vib.*, vol. 27, no. 4, pp. 477-513, 1973.

[17] B. J. Tester, "The propagation and attenuation of sound in lined ducts containing uniform or Plug flow," vol. 28, pp. 151-203, 1973.

[18] B. Zhang, J. He and Y. Ji, "Dependence of the average mobility of ions in air with pressure and humidity," in IEEE Transactions on Dielectrics and Electrical Insulation, vol. 24, no. 2, pp. 923-929, 2017

LIST OF REFERENCES IN THE DRAWINGS

- Installation structure 1
  - Ventilation duct 1*a*
  - Window 1*b*
  - Room, cabinet 1*c*
- Active noise reduction system 2
  - Support 3
    - Enclosure 4
      - Backing wall 21
      - Open side 22
  - Electroacoustic plasma transducer 5
    - Electrode arrangement 6
      - Collector electrode 8
      - Corona electrode 9
      - Grounded electrode 27
      - Support frame 10
    - Control system 7
      - Controller 12
      - Amplification circuit 13
        - Power supply 14
        - DC power supply 15
        - Switched mode circuit 16
        - Transformer 17
        - Flyback transformer
        - Rectifier 18
      - Load resistor 19
      - Vacuum tube 20
        - Control grid electrode 24
        - Anode 25
        - Cathode 26
        - Feedback line 28
      - Operational amplifier 29
        - Non-inverting input 30
        - Output 31
      - Low voltage DC or AC source 23
  - Acoustic sensing system (microphone) 11
- duct axis A

The invention claimed is:

1. An active noise reduction system comprising an electroacoustic plasma transducer for mounting in an installation structure and an acoustic sensing system, the electroacoustic plasma transducer comprising a plasma electrode arrangement including a collector electrode and a corona electrode, and a control system connected to the plasma electrode arrangement for supplying power to the plasma electrode arrangement, the control system comprising a controller, and a amplification circuit, the acoustic sensing system connected to the control system providing a measurement signal of an environmental sound to control the output of the electroacoustic transducer for reducing noise, wherein the control system comprises a filter implementing a control transfer function $\theta(s)$ based on a model of the electroacoustic plasma transducer, said filter implementing said control transfer function $\theta(s)$ being further based on a frequency-dependent target acoustic impedance $Z_{tg}(\omega)$.

2. The active noise reduction system of claim 1, wherein the acoustic sensing system comprises a microphone connected to the control system and placed on an open side of the plasma electrode arrangement facing a source of noise to be reduced.

3. The active noise reduction system of claim 2, wherein the filter outputs a voltage signal $u_{AC}(s)$ fed into the amplification circuit of the control system configured to drive the electrode arrangement to achieve said frequency-dependent target acoustic impedance at the position of the microphone.

4. The active noise reduction system of claim 2, wherein the microphone is positioned at a distance of less than 20 mm from the open side of the plasma electrode arrangement.

5. The active noise reduction system of claim 1, wherein the filter is an Infinite Impulse Response (IIR) filter.

6. The active noise reduction system of claim 1, wherein said model of the electroacoustic transducer comprises parameters selected from any one or more of:

geometrical parameters, such as: a distance d between the corona electrode and the collector electrode, a cross section area of the electrode arrangement $S_e$, a distance L from a center of electrode arrangement to an enclosure;

a back impedance $Z_L$ corresponding to the presence of an enclosure behind the electrode arrangement;

environmental parameters, such as: ambient gas temperature $T_0$, sound speed in gas c, gas mass density ρ;

discharge parameters, such as: effective ion mobility $\mu_i$, critical corona voltage $U_0$, and dimensional constant C.

7. The active noise reduction system of claim 6, wherein said discharge parameters critical corona voltage $U_0$ and dimensional constant C are obtained by applying different constant voltages U and recording the electrical currents I between the corona and collector electrodes whereby for data points where said current is not zero, a recorded curve can be fitted with formula $I=CU(U-U_0)$ and therefrom the critical corona voltage $U_0$ and dimensional constant C parameters can be obtained.

8. The active noise reduction system of claim 1, wherein the amplification circuit comprises a feedback line connected between the electrode arrangement and the amplification circuit.

9. The active noise reduction system of claim 1, wherein the amplification circuit comprises a plurality of amplification channels connected to a plurality of said plasma electrode arrangements configured to feed each electrode arrangement with an individual alternating electrical voltage signal.

10. The active noise reduction system of claim 9, wherein each amplification channel of the amplification circuit comprises a vacuum tube.

11. The active noise reduction system of claim 9, wherein each amplification channel of the amplification circuit comprises a load resistor that may have a different value from load resistors of other channels for setting the amplification level of each channel adapted to the desired operation of the electrode arrangement connected thereto.

12. The active noise reduction system of claim 1, wherein the amplification circuit comprises a DC power supply, a switched mode circuit connected to the DC power supply, and a transformer and rectifier connected to the switched mode circuit.

13. The active noise reduction system of claim 12, wherein the amplification circuit comprises a vacuum tube, an anode of a vacuum tube being connected to an output of the rectifier via a load resistor.

14. The active noise reduction system of claim 1 wherein the collector electrode is at least partially transparent.

15. The active noise reduction system of claim 1 wherein the amplification circuit generates a maximum transducer operating voltage in a range of 5 to 20 kV, more preferably in a range of 5 to 15 kV.

16. The active noise reduction system of claim 1 wherein a distance d between the corona electrode and the collector electrode, and maximum transducer operating voltage difference $U_{max}$ between the corona electrode and collector electrode, is chosen in order to satisfy the relation: $U_{max}/d=1.8-2*10^6$ V/m.

17. The active noise reduction system of claim 1 wherein the corona electrode comprises an array of electrode segments spaced from each other at a distance between 1.5*d and 3*d, where d is the closest distance between the corona electrode and the collector electrode.

18. The active noise reduction system of claim 1 wherein the electroacoustic plasma transducer comprises an enclosure on one side of the plasma electrode arrangement.

19. The active noise reduction system of claim 1 wherein said plurality of plasma electrode arrangements comprises one corona electrode and a plurality of collector electrodes associated with said one corona electrode.

20. The active noise reduction system of preceding claim 19 wherein the plurality of collector electrodes form together a 3D shape surrounding the corona electrode.

21. The active noise reduction system of preceding claim 20 wherein the 3D shape is substantially spherical.

22. The active noise reduction system of claim 1 wherein the plurality of electrode arrangements are installed in a window.

23. The active noise reduction system of claim 22 wherein the plurality of electrode arrangements are installed in a frame of window.

24. The active noise reduction system of claim 22 wherein the plurality of electrode arrangements are installed in a plenum of the window, substantially parallel to a panel of the window.

25. The active noise reduction system of claim 1 wherein the plurality of electrode arrangements are installed in an exhaust or ventilation duct.

26. The active noise reduction system of claim 25 wherein the plurality of electrode arrangements are installed transversely across an axis of the exhaust or ventilation duct.

* * * * *